United States Patent [19]

Specht et al.

[11] 4,096,054

[45] Jun. 20, 1978

[54] RISERLESS FLEXIBLE ELECTRODE ASSEMBLY

[75] Inventors: Steven J. Specht; Kenneth E. Woodard, Jr., both of Cleveland, Tenn.

[73] Assignee: Olin Corporation, New Haven, Conn.

[21] Appl. No.: 845,524

[22] Filed: Oct. 26, 1977

[51] Int. Cl.[2] ..... C25B 9/00; C25B 11/03; C25B 11/10

[52] U.S. Cl. ..... 204/263; 204/283; 204/290 F; 204/290 R

[58] Field of Search ..... 204/263-266, 204/282-284, 286-288, 225, 290 F, 290 R

[56] References Cited

U.S. PATENT DOCUMENTS

| | | | |
|---|---|---|---|
| 3,674,676 | 7/1972 | Fogelman | 204/286 |
| 3,873,437 | 3/1975 | Pulver | 204/288 X |
| 4,028,214 | 6/1977 | Ford et al. | 204/286 |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

An expandable electrode assembly is provided having two opposed working faces of flexible electrically conductive material, said faces defining a riserless open chamber therebetween, a plurality of spring means interposed between the working faces for biasing the faces a limited distance away from each other and for allowing inward movement of the faces toward each other in response to inward force applied to the working faces, and an electrical conductor means affixed to one edge of each of the planar faces to a supportive backplate without limiting the inward movement of the edge of the faces opposite the one edge.

16 Claims, 11 Drawing Figures

RISERLESS FLEXIBLE ELECTRODE ASSEMBLY

This invention relates to electrodes for electrolytic cells.

Numerous solutions have been proposed for the problem of interelectrode contact during interleaving of planar electrodes for diaphragm type electrolytic cells, among such solutions being expandable or contractable electrodes which can be reduced in thickness during the interleaving operation to increase the anode-to-cathode gap during interleaving and thereby lessen abrasive contact between electrodes and yet still be able to expand to assume a normal thickness with a lesser desired anode-to-cathode gap following interleaving so as to allow efficient cell operation.

However, all of such methods and apparatus for expandable electrodes involve use of an electrode having either a "riser", or vertical conductor bar, or a horizontal electrode supportive conductor bar. This is so because there is a dual need first to support the electrode working faces and second to conduct electricity to or from the working faces during electrolysis. However, the presence of this riser has limited the contraction of the electrode and limited flexibility of the electrode in the direction parallel said conductor bar or riser. In the prior art designs this is a problem because the electrodes are not precisely aligned prior to installation unless rather detailed and cumbersome adjustments and measurements are made. Also, the expansion and contraction is generally designed to be uniform along the direction of the conductor bar, whereas the most desirable configuration during interleaving would seem to be a minimum thickness at the end between which the opposed electrodes will be first inserted. Also, there is a need for an electrode which can automatically adapt to various configurations of opposed electrodes without extensive modification, so that slightly irregular opposed electrodes can be used, if desired. Therefore, there is need for a better, more flexible electrode.

A solution to these and other problems is the apparatus of this invention which provides an expandable electrode assembly, which comprises:

(a) at least two opposed planar working faces of flexible electrically conductive material, said faces defining a riserless open chamber therebetween;

(b) at least one spring means, interposed between said working faces, for biasing said faces a limited distance away from each other and for allowing inward movement of said faces in an inward direction toward each other in response to a force applied to said working faces in said inward direction; and (c) an electrical connector means, affixed to one edge of each of said planar faces, for electrically connecting said faces to a supportive backplate without limiting said inward movement of the edge of said faces opposite said one edge.

Also provided by the invention is, in combination with an expandable electrode of the type having two opposed working surfaces with an outwardly biasing spring means therebetween, the improvement which comprises:

(a) first stiffener bar means, attached to one of said two working faces and having an outward projection, for spreading inward and outward forces along said one of said working faces so as to produce more uniform movements of said one of said working faces;

(b) second stiffener bar means, attached to the other of said two working faces and having an outward projection, for spreading inward and outward forces along said other of said working faces so as to produce more uniform movements of said other of said working faces;

(c) keeper plate means, surrounding said outward projections, for automatically limiting movement of said projections away from each other and allowing unrestrained movement of said projections toward one another.

The objects and advantage of the invention will be better understood by reference to the attached drawing in which.

As used herein "diaphragm" shall include membranes of the ion exchange type as well as fabric-like synthetic diaphragm structures and materials and also include the more conventional vacuum formed separative layers customarily provided in electrolytic cells, such as for example those used to produce alkali metal hydroxides and halogens from alkali metal halide solutions.

Figure 1:
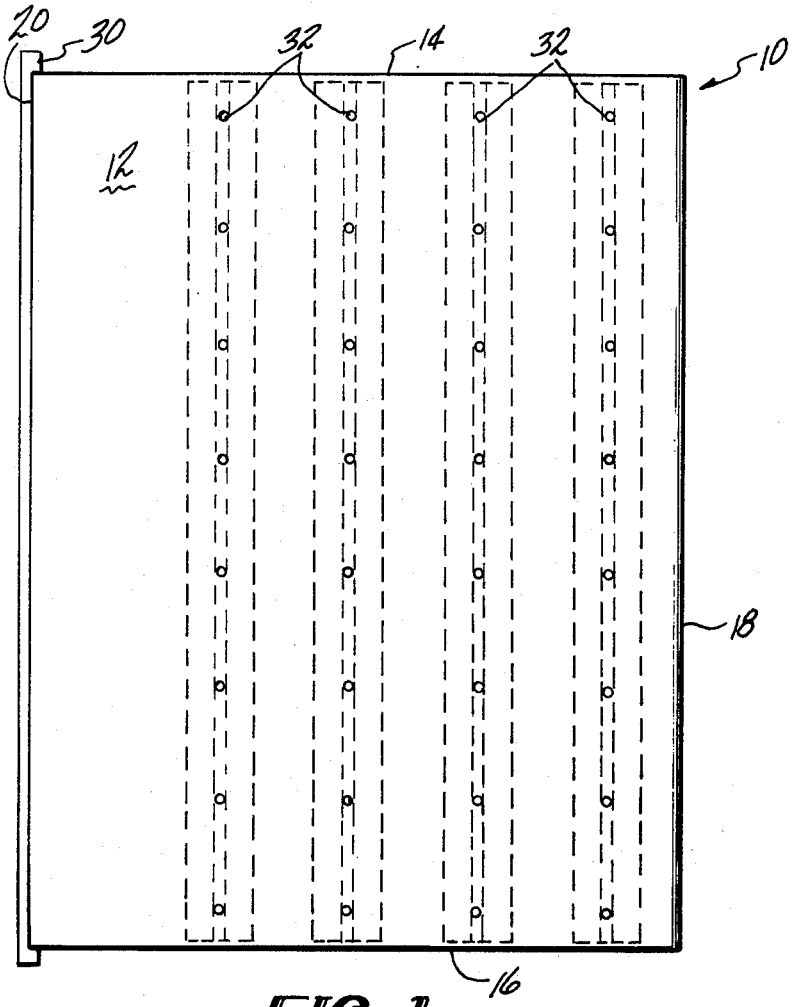
FIG. 1 is a side elevational view of an electrode embodying the invention.

FIG. 1 is a side elevational view of a first preferred embodiment of the electrode of the invention. Electrode 10 is a planar electrode of any suitable electrolytic cell having planar interleaved electrodes, such as for example the electrolytic diaphragm cell of U.S. Pat. No. 3,898,149 issued Aug. 5, 1975 to M. S. Kircher and E. N. Macken, which discloses tubular bodied diaphragm type electrolytic cells having multiple interleaved planar electrodes. Electrode 10 could alternatively be an electrode usable in a conventional diaphragm cell such as that disclosed in U.S. Pat. No. 3,904,504 issued Sept. 9, 1975 to W. W. Ruthel and L. G. Evans or some other similar cell. Referring now to FIGS. 1–4, electrode 10 comprises two working faces 12 and 13, a conductor bar 30 and a plurality of stiffener bars 22–29. Working faces 12 and 13 are rectangular planar foraminous mesh sheets having top edges 14 and 15, bottom edges 16 and 17 (not shown), outer edges 18 and 19 and inner edges 20 and 21 (not shown), respectively. Faces 12 and 13 can be separate and unconnected as shown in the Figures, in some embodiments, or surfaces 12 and 13 may be joined across the "front", "leading" or "outer" edges 18 and 19, for example, by attaching a flexible section of the same mesh material employed as surfaces 12 and 13. The flexible section may also be attached by means such as soldering, welding, brazing or the like. If desired, the electrode surfaces can also be joined along the other edges. This is required where, for example, the electrode surfaces serve as a cathode in a diaphragm cell which has a vacuum deposited asbestos fiber type diaphragm. The electrode surfaces could be sealed along the edges and the electrode surfaces also attached to the electrode plate to form a liquid impervious catholyte chamber. A diaphragm could then be attached or deposited on the electrode surfaces of the electrode and outlets could be provided for the removal of gaseous and liquid products from the electrode compartment. In the case of a cathode where any of the edges 14, 15, 16, 17, 18, 19, 20 or 21 are not connected it is preferred to have the mesh either doubled back against itself (see FIG. 3) or capped to protect the diaphragm from scratching, puncturing or tearing due to sharp exposed edges being forced against the diaphragm.

it will be understood that, depending on whether the electrode assembly of the present invention serves as a cathode or anode, the materials of construction for the faces 12 and 13 are suitably selected to be resistant to the gases and liquids to which faces 12 and 13 are exposed. For example, while serving as an anode, faces 12 and 13 can be a conductive metal having a platinum group metal electrocatalytic coating. As used herein "platinum group metal" means an element of the group consisting of ruthenium, palladium, rhodium, osmium, iridium and platinum. Where the electrode assembly serves as the cathode, the mesh is suitably, for example, stainless steel, carbon steel, nickel, copper, iron or a coated conductive material such as nickel-molybdenum coated copper.

When used as an anode, surfaces 12 and 13 can be in various forms such as flexible solid sheets, flexible perforated sheets or flexible expanded mesh which is flattened or unflattened and can have slits horizontally, vertically or angularly. Other suitable forms include flexible woven wire which is flattened or unflattened, bars or wires, or strips arranged, for example, vertically and sheets having perforations, slits or louvered openings.

A preferred anode working face is a foraminous metal mesh having good electrical conductivity in the direction perpendicular to conductor bar 30 along the face. Preferred materials for such an anode are either titanium or a silicon compound.

As the cathode, faces 12 and 13 are suitably a metal screen or mesh where the metal is, for example, stainless steel, iron, carbon steel, nickel or tantalum.

Conductor bars 30 can be of any convenient form such as rods, strips or bars. A preferred conductor bar 30 is a bar of copper. In one preferred configuration, conductor bar 30 is attached to inner edges 20, 21 of faces 12, 13 respectively. The conductor bar 30 conducts current to or from faces 12, 13 depending on the polarity of the electrode 10.

Figure 2:
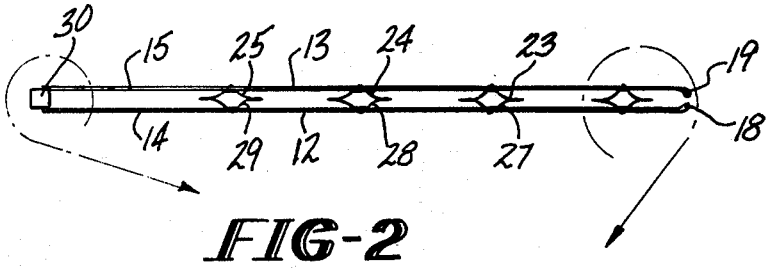
FIG. 2 is a top plan view of the electrode of FIG. 1.
Figure 3:
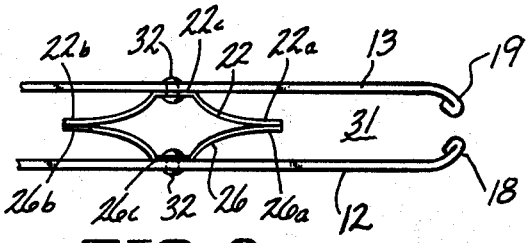
FIG. 3 is a top plan view of a right end portion of the electrode of FIG. 2.
Figure 4:
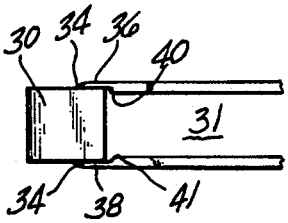
FIG. 4 is a top plan view of a left end portion of the electrode of FIG. 3.

As best seen in FIGS. 2–4, a plurality of parallel stiffener bars 22, 23, 24 and 25 are connected to face 13 by welds or rivets 32 and preferably lie parallel to and spaced from conductor bar 30, although the particular orientation of bars 22, 23, 24 and 25 could be changed so as to achieve flexibility in any desired direction. Corresponding stiffener bars 26, 27, 28 and 29 are connected to face 12 and lie in parallel opposed contact with bars 22–25, respectively. Bars 22–29 are comprised of a resilient material so that they serve as a spring between faces 12 and 13 tending to force faces 12 and 13 a limited distance away from one another and yet capable of allowing movement of faces 12 and 13 toward each other.

FIG. 3 shows preferred stiffener bars 22 and 26 in greater detail. Stiffener bar 22 is seen to comprise a middle portion *22c* and two side portions *22a* and *22b* projecting arcuately from face 13 toward face 12 and outwardly from middle portion *22c*. Stiffener bar 26 has corresponding middle portion *26c* and side portions *26a* and *26b*. Middle portions *22c* and *26c* are connected by suitable welds or rivets 32 to faces 13 and 12, respectively. Side portion *22a* and *26a* abut resiliently, as do side portions *22c* and *26c*. Abutting stiffener bars 22 and 26 thus serve to resiliently bias faces 12 and 13 a limited distance apart. If desired, portions *22a* and *26a* can be connected by welding as can portions *22c* and *26c*. The remaining stiffener bars 23–25 and 27–29 can be constructed and abutted in similar manner to provide four combination bars (not numbered). Any other number of stiffener bars could be used, if desired. The stiffener bars, preferably being parallel conductor bar 30, serve to give the electrode rigidity in the direction parallel to conductor bar 30. In FIGS. 1–4, this direction is vertical, although it will be appreciated that the conductor bar 30 could be oriented horizontally, as for example by placing the conductor bar along top edges 14 and 15 instead of inner edges 20,21 and then orienting a suitable number of stiffener bars in the horizontal direction or even inclined slightly to serve as baffles for gas. Stiffener bars 22–29 also serve to give the electrode some rigidity as far as thickness by virtue of the resilience of bars 22–29, however any rigidity in the "longitudinal" direction or direction of current flow, i.e., from inner edges 20, 21 toward outer edges 18, 19 is only indirectly provided by the rigidity in the other two directions above noted. Thus the electrode 10 is able to contract and yield when interleaved between two opposed electrodes.

The inner ends 20, 21 can be connected to conductor bar 30 as shown in FIG. 4, or in any other suitable manner. In FIG. 4, welds 34 are provided to connect flattened mesh portions 38 and 36 of faces 12 and 13, respectively to conductor bar 30 and the flattening of portions 36 and 38 in turn provides shoulders 40 and 41 facing toward conductor bar 30 and resisting movement of conductor bar 30 and faces 12 and 13 further toward one another.

A second electrode 11 is shown in FIGS. 5–10. Electrode 11 comprises conductor bar 30, faces 12 and 13 and a plurality of stiffener channels 42–49. Stiffener channels 42–49 correspond in position to previously described channels 22–29, however channels 42–49 need not be resilient and are preferably made of very rigid material. Channels 47–49 are not seen in the FIGURES but are positioned opposite channels 43–45 in the same manner as channel 46 is opposite channel 42. Like bars 22–29, channels 42–49 can be conductive, if desired, but run transverse to the direction of electrical flow and hence are not properly termed "conductors".

Also, while channels 22–29 abutted one another, channels 42–49 do not abut, but rather are spaced apart a limited distance sufficient to allow for "contraction" or motion of face 12 toward face 13, as during the interleaving operation. Channels 42–45 are connected by welds 50 to face 13 and channels 46–49 are connected to face 12 by corresponding welds 50. Faces 12 and 13 can be interconnected by a keeper plate assembly 67 (see FIGS. 8–10) which limits outward movement of faces 12 and 13 away from each other. A spring 52 (see FIG. 6) is provided to resiliently bias channels 42–45 away from corresponding channels 46–49 and thereby resiliently bias face 13 away from face 12.

Figure 6:
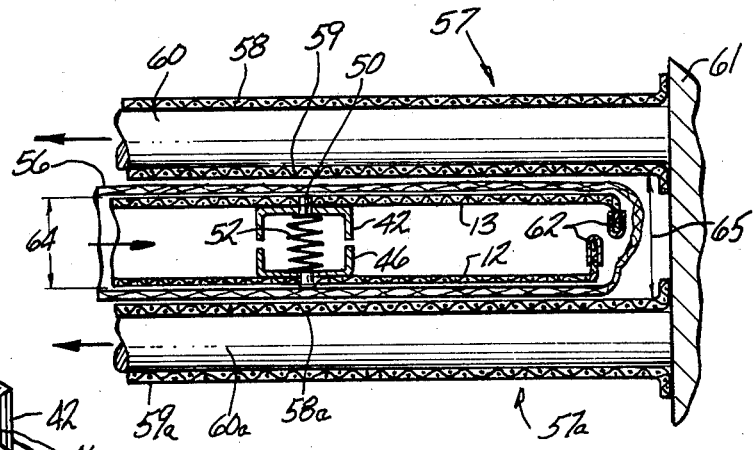
FIG. 6 is a cross-sectional view through an electrolytic cell showing the electrode of FIG. 5 in contracted position.
Figure 7:
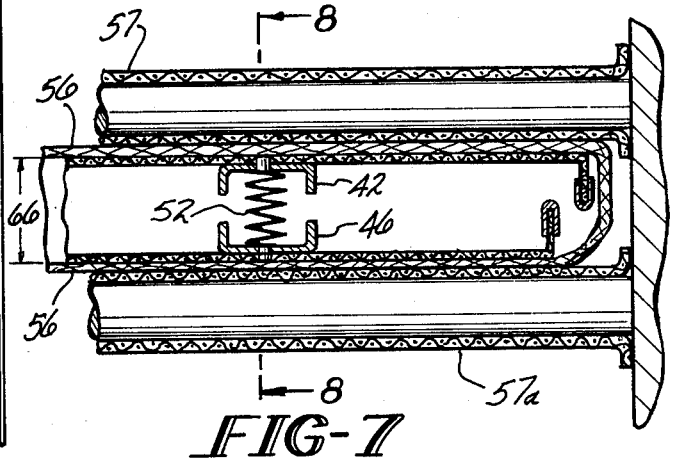
FIG. 7 is a cross-sectional view through an electrolytic cell showing the electrode of FIG. 5 in expanded position.

Referring to FIGS. 6 and 7, faces 12 and 13 can be provided with edge protectors 62 to protect against damage to any diaphragm or membrane 56 which otherwise might occur due to sharp exposed edges of faces 12 and 13. FIGS. 6 and 7 are cross-sectional views through an electrolytic cell such as that of U.S. Pat. No. 3,898,149 to M. S. Kircher et al issued Aug. 5, 1975. In FIG. 6 faces 12 and 13 of electrode 11 are surrounded by a membrane 56. Membrane 56 can also be a "diaphram" of either the synthetic fabric type or could be a vacuum deposited "fibrous" diaphragm such as asbestos, synthetic resin or mixtures thereof if edges 14–21 were joined by flexible mesh or other suitable means for fully supporting the diaphragm.

Figure 5:
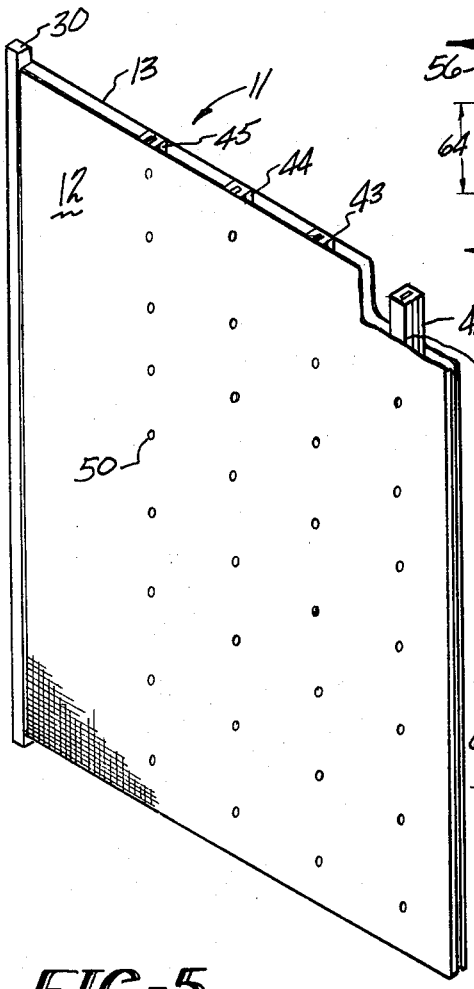
FIG. 5 is an isometric view of a second electrode embodying the invention.

In FIGS. 5, 6 and 7, electrode 11 is a cathode and is interleaved between anodes 57 and **57*a*. Anodes 57 and 57*a* comprise first faces 58 and 58*a*, second faces 59 and 59*a* and conductor bars 60 and 60*a*. Anodes 57 and 57*a* are rigid electrodes, which could abrade, bind or tear diaphragm or membrane 56 if electrode 11 was not capable of contraction during the interleaving procedure. Conductors 60, 60*a* of anodes 57, 57*a* are typical of prior art configurations which result in longitudinal rigidity. However, expandable or contractable anodes could also be constructed in accordance with the invention and substituted for rigid anodes 57 and 57*a***.

A suitable method of contracting electrodes 10 and 11 is use of a vacuum assembly method such as that disclosed in commonly owned parent application Ser. No. 782,643, filed Mar. 30, 1977, now U.S. Pat. No. 4,078,987, by S. J. Specht, joint inventor hereof, which is hereby incorporated by reference as if set forth at length herein. In such a method the flexible electrode 10 or 11 is enclosed by a gas flow resistant diaphragm or membrane. Fluid conduits are provided to the interior of the diaphragm enclosed flexible electrode and through these conduits the electrode is evacuated at least partially to create a differential pressure upon said diaphragm which in turn presses against the electrode and contracts the electrode. This pressure differential is maintained during interleaving of anodes and cathodes so as to achieve a greater anode to cathode gap during such interleaving and thereby help prevent damage to the diaphragm. Also, other suitable contraction means can be used, including simply forcing the electrode 11 between anodes 57, **57*a* and allowing the resilient electrode 11 to contract under the force of insertion. Slip sheets could be placed over the outer edges 18 and 19** and surrounding diaphragm to protect the diaphragm during the initial stages of such insertion.

FIGS. 6 and 7 show electrode 11 in contracted and expanded position, respectively. Inward movement of faces 12 and 13 and hence minimum thickness are limited by engagement of inner edges 96 and 98 (see FIG. 8) of channels 42–45 with channels 46–49 and outward expansion by keeper assemblies 67.

Figure 9:
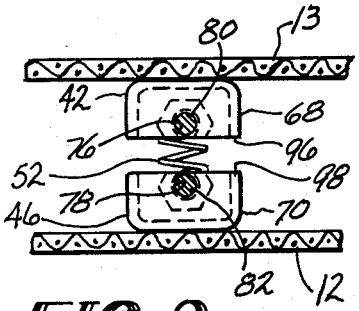
FIG. 9 is a horizontal cross-section taken along lines 9—9 of FIG. 8, showing a stiffener bar.
Figure 8:
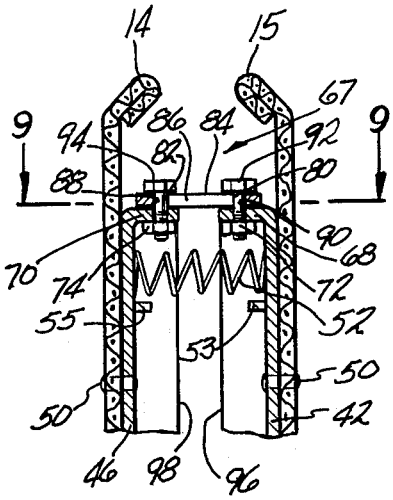
FIG. 8 is a vertical cross-sectional view taken along lines 8—8 of FIG. 7, showing a keeper assembly.
Figure 10:
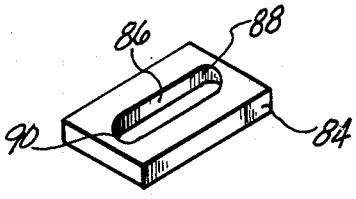
FIG. 10 is an isometric view of the keeper plate of FIG. 8.

FIGS. 8–10 show keeper assembly 67 in greater detail. Keeper assembly 67 comprises top flanges 68 and 70 of channel 42 and 46, respectively, nuts 72 and 74, keeper bolts 80 and 82 and keeper plate 84. Top flanges 68 and 70 are preferably a horizontally inwardly bent integral part of channels 42 and 46, respectively. Flanges 68 and 70 define vertical boltholes 76 and 78 (see FIG. 9) aligned with threaded holes of nuts 72 and 74 so as to receive and secure keeper bolts 80 and 82 in a vertical orientation. Keeper plate 84 (see FIG. 10) has a central slot 86 and first and second stop portions 88 and 90 to limit movement of keeper bolts 80 and 82 outwardly away from one another. Keeper bolts 80 and 82 are inserted through slot 86 and boltholes 76 and 78 and threaded into engagement with nuts 72 and 74. Keeper bolts 80 and 82 have boltheads 92 and 94 to prevent keeper plate 84 from moving upwardly off of keeper bolts 80 and 82. A similar keeper assembly 67 and spring 52 are at the lower end of channels 42 and 46 and at the upper and lower ends of channel pairs 43 and 47, 44 and 48, and 45 and 49 thus limiting the outward relative movement of faces 12 and 13 and limited spring-biased inward relative movement of faces 12 and 13 thereby limiting "expansion" of electrode 11. "Contraction" of electrode 11 is limited by engagement of inner rims 96 of channels 42–45 with inner rims 98 of channels 46–49. Springs 52 or lugs (not shown) or electrode ends 62 could similarly serve to limit contraction. Inwardly projecting ledges 53 and 55 are preferably provided on channels 42–45 and 46–49, respectively to maintain the vertical positions of the spring 52 adjacent each such assembly 67. Springs 52 could be replaced by leaf springs of suitable design, and such leaf springs could be supported by hooks engaging ledges 68 and 70. These leaf springs and hooks could substitute for keeper assembly 67.

Figure 11:
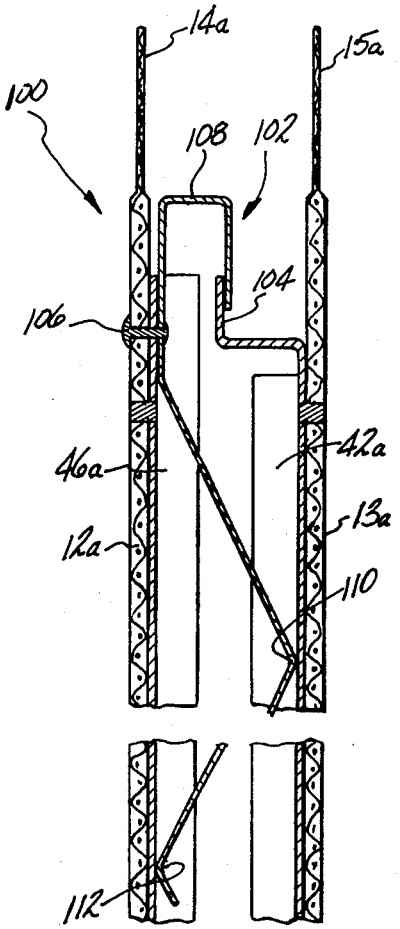
FIG. 11 is a vertical cross-section similar to that of FIG. 8, but showing instead a preferred leaf spring and hook assembly which could be substituted for the keeper assembly of FIG. 8.

A preferred leaf spring and hook assembly 100 is seen in FIG. 11. Assembly 100 includes a J-leaf spring 102, L-ends 104 and rivets 106. Springs 102 are leaf springs adapted to fit within modified versions of stiffener bars **42*a*–49*a* (only 42*a* and 46*a* are shown). Springs 102 have an outer end 108, a central portion 110 and an inner end 112. Springs 102 are riveted at outer end 108 to bars 42*a*–49*a*. Ends 112 lie in sliding contact with stiffener bars 42*a*–45*a*. Thus when mesh 12*a* and 13*a* (see below) are moved toward one another in response to an applied external force, portions 110 tend to flatten out and ends 112 slide downward away from rivets 106. Spring 102 is made of resilient material which opposes this flattening and which rebounds to expand the electrode when the external force is lessened. Outer end 108 is a J-shaped hook which opens toward the interior of the electrode. Also, upper sides 14*a* and 15*a* are provided and are flattened portions of mesh 12*a* and 13*a*. This flattenting tends to give extra rigidity to the edges of the mesh without signficantly decreasing flexibility. It will be understood that there are preferably eight such assemblies 100, one at each of the lower and upper ends of the four pairs of stiffener bars. The assembly 100 at the lower end of the stiffener bar would preferably be inverted from that of FIG. 11 in order that end 112** thereof move upwardly toward the interior of the electrode rather than downwardly.

The operation of electrodes 10 and 11 is self-evident from the above description. It should be noted that conductor bar 30 will maintain a fixed thickness of electrodes 10 and 11 at inner edges 20 and 21, so that the electrodes 10 and 11 will assume a somewhat tapered configuration in at least the region between bars 25, 29 or channels 45, 49 and conductor bar 30 since the bars and channels are resiliently interconnected to make electrodes 10 and 11 contractable and expandable.

It will be appreciated that the particular number of channels or bars is a matter of design choice dependent on the size and flexibility of the material utilized for faces 12 and 13.

The diaphragm or membrane 56 can be of any suitable material such as a membrane composed of an inert, flexible material having cation exchange properties and which is impervious to the hydrodynamic flow of the electrolyte and the passage of chlorine gas and chloride ions. A first preferred membrane material is a perfluorosulfonic acid resin membrane composed of a copolymer of a polyfluoroolefin with a sulfonated perfluorovinyl ether. The equivalent weight of the perfluorosulfonic acid resin is from about 900 to about 1600, and preferably from about 1100 to about 1500. The perfluorosulfonic acid resin may be supported by a polyfluoroolefin fabric. A composite membrane sold commercially by E. I. DuPont deNemours and Company under the trademark "Nafion" is a suitable example of the preferred membrane.

A second preferred membrane is a cation exchange membrane using a carboxyl group as the ion exchange group and having an ion exchange capacity of 0.5–2.0 mEq/g of dry resin. Such a membrane can be produced by chemically substituting a carboxyl group for the sulfonic group in the above-described "Nafion" membrane to produce a perfluorocarboxylic acid resin supported by a polyfluoroolefin fabric. A second method of producing the above-described cation exchange membrane having a carboxyl group as its ion exchange group is that described in Japanese Patent Publication No. 1976–126398 by Asahi Glass Kabushiki Gaisha issued Nov. 4, 1976. This method includes direct copolymerization of fluorinated olefin monomers and monomers containing a carboxyl group or other polymerizable groups which can be converted to carboxyl groups.

Alternatively, membrane 56 can be a diaphragm of conventional vacuum deposited asbestos fiber or other suitable fibers or can be a polymer stabilized asbestos or other fiber diaphragm or a synthetic fabric-like structure compressed of particles of the perfluorosulfonic acid resin or perfluorocarboxylic acid resin above disclosed or other suitable separative material.

The electrodes 10 and 11 may also be used in cells having no diaphragm, such cells being conventionally designed to produce oxychlorine compounds or alkali metal chlorates.

An anode backplate 61 is seen supporting anodes 57 and **57*a* of FIGS. 6 and 7. A corresponding conductive or nonconductive backplate could be provided to define, in part, the electrolytic cell and to support conductor bar 30. Conductor bar 30 could be bolted to the corresponding backplate. However, conductor bar 30 must be electrically connected to either anodic or cathodic bus bars, depending on whether electrode 10 or 11** is an anode or cathode, respectively, although such connection can be indirect.

With the above detailed description in mind as a preferred example, it will be appreciated that many modifications are possible. For example, the conductor bar 30 could be eliminated and the faces connected directly to an electrode backplate or conductive cell wall, in which case the backplate or wall would serve as the conductor bar 30. Also, any mesh design could be used so long as the mesh provides sufficient conductivity and flexibility. Also, any spring design other than the compression spring design shown for spring 52 can be utilized so long as the spring design will allow expansion and contraction of the electrode in the above-described manner, for example, a leaf spring having hooked ends passing through corresponding apertures in the stiffener bar top flanges 68 and 70. Such a leaf spring could also serve as the keeper assembly. While the electrode is described in terms of utility in a cell which processes concentrated brine to produce caustic soda, chlorine and hydrogen, cells using other raw materials to make other products can also utilize the invention and the invention includes such usages. The mesh of faces 12 and 13 may be louvered such as, for example, in U.S. Pat. No. 3,930,151 to Shibata et al issued Dec. 30, 1975, herein incorporated by reference as if set forth at length, so long as sufficient space is provided for electrode contraction. The invention can be used as cathodes and anodes in the same cell with or without diaphragms or membranes over the electrode of this invention. A spacer mesh can be utilized between the electrode and membrane or diaphragm to achieve a desired final gap between one or both of the anodes and cathodes and the diaphragm or membrane. The following claims are thus to be accorded the broad range of equivalents which the invention encompasses.

What is claimed is:

1. An expandable electrode assembly, which comprises:

(a) at least two opposed planar working faces of flexible electrically conductive material, said faces defining a riserless open chamber therebetween;

(b) at least one spring means, interposed between said working faces, for biasing said faces a limited distance away from each other and for allowing inward movement of said faces in an inward direction toward each other in response to a force applied to said working faces in said inward direction; and (c) an electrical connector means, affixed to one edge of each of said planar faces, for electrically connecting said faces to a supportive backplate without limiting said inward movement of the edge of said faces opposite said one edge.

2. The assembly of claim 1, further comprising a stiffener bar means, attached to one of said working faces and separated from said electrical connector means, for stiffening said electrode in the direction within the plane of said planar electrode and transverse to the direction from said one edge to said edge opposite said one edge.

3. The assembly of claim 2 wherein said stiffener bar means lie parallel to said electrical connector means.

4. The assembly of claim 3 wherein said spring means are integral with said stiffener bar means.

5. In combination with an expandable electrode of the type having two opposed working surfaces with an outwardly biasing spring means therebetween, the improvement which comprises:

(a) first stiffener bar means, attached to one of said two working faces and having an outward projection, for spreading inward and outward forces along said one of said working faces so as to produce more uniform movements of said one of said working faces;

(b) second stiffener bar means, attached to the other of said two working faces and having an outward projection, for spreading inward and outward forces along said other of said working faces so as to produce more uniform movements of said other of said working faces; and (c) keeper plate means, surrounding said outward projections, for automatically limiting movement of said projections away from each other and allowing unrestrained movement of said projections toward one another.

6. The improvement of claim 5 further comprising retainer means, attached to said projections, for releasably maintaining said keeper plate means in a position surrounding said projections.

7. The improvement of claim 5, wherein said spring means comprises at least two compression springs placed between said stiffener bars.

8. The assembly of claim 1, wherein said spring means comprises at least two compression springs placed between said stiffener bars.

9. The assembly of claim 1, further comprising a diaphragm type layer means, surrounding said faces, for applying an inward differential pressure to said faces in response to withdrawal of fluid from said open chamber.

10. The assembly of claim 1, wherein said assembly is a cathode of an electrolytic cell.

11. The assembly of claim 10 wherein said cathode includes a mesh surface having a substrate comprising a transition metal.

12. The assembly of claim 10 wherein said cathode includes a mesh surface having a substrate comprising a stainless steel.

13. The assembly of claim 1, wherein said assembly is the anode of an electrolytic cell.

14. The assembly of claim 13 wherein said anode includes a mesh surface having a substrate comprising one of the group consisting of titanium, tantalum, niobium and silicon.

15. The apparatus of claim 2, wherein said spring means is a leaf spring supported by said electrode assembly.

16. The apparatus of claim 15 wherein said leaf spring includes end means for engaging with said stiffener bar means to limit outward movement of said working faces relative to each other.

* * * * *